US006364718B1

(12) United States Patent
Polgar et al.

(10) Patent No.: US 6,364,718 B1
(45) Date of Patent: Apr. 2, 2002

(54) KEYING SYSTEM FOR ELECTRICAL CONNECTOR ASSEMBLIES

(75) Inventors: Gary E. Polgar, Bolingbrook; Joseph D. Comerci, Elmhurst, both of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/776,160

(22) Filed: Feb. 2, 2001

(51) Int. Cl.[7] ..... H01R 13/64
(52) U.S. Cl. ..... 439/680; 439/488; 439/491
(58) Field of Search ..... 439/480, 488, 439/491, 681

(56) References Cited

U.S. PATENT DOCUMENTS

| | | | | | |
|---|---|---|---|---|---|
| 4,455,056 | A | | 6/1984 | Herrmann, Jr. et al. | 339/91 |
| 4,586,773 | A | | 5/1986 | Lothmann et al. | 339/91 |
| D316,080 | S | | 4/1991 | Inaba | D13/146 |
| 5,342,221 | A | | 8/1994 | Peterson | 439/677 |
| 5,344,347 | A | * | 9/1994 | Inoue et al. | 439/701 |
| 5,520,555 | A | * | 5/1996 | Taylor | 439/680 |
| 5,628,648 | A | | 5/1997 | Higgins, Jr. et al. | 439/489 |
| 5,727,963 | A | | 3/1998 | LeMasters | 439/358 |
| D420,980 | S | * | 2/2000 | Tennessen | D13/146 |
| 6,168,475 | B1 | * | 1/2001 | Ko | 439/680 |

* cited by examiner

*Primary Examiner*—P. Austin Bradley
*Assistant Examiner*—Alexander Gilman
(74) *Attorney, Agent, or Firm*—Stephen Z. Weiss

(57) ABSTRACT

A keying system for an electrical connector assembly includes a male connector having a body portion, a mating end formed by a plurality of terminal-receiving silos extending from the body portion, and a plurality of support walls integrally joining the silos and combining therewith to define a pattern of interior keying channels. A female connector has a mating end formed by a receptacle, with a plurality of terminals including contact portions extending into the receptacle for insertion into the silos of the male connector. A plurality of locating walls within the receptacle define a pattern of keying members for insertion into the keying channels of the male connector to thereby polarize the connectors.

4 Claims, 3 Drawing Sheets

KEYING SYSTEM FOR ELECTRICAL CONNECTOR ASSEMBLIES

FIELD OF THE INVENTION

This invention generally relates to the art of electrical connectors and, particularly, to a keying system for a pair of connectors in an electrical connector assembly.

BACKGROUND OF THE INVENTION

Generally, an electrical connector assembly includes a pair of connectors individually terminated to a circuit component, such as an electrical cable, a printed circuit board, a flat circuit or the like. The connectors are mateable to electrically interconnect the respective circuit components. For instance, one connector of the assembly may be a male or plug connector mateable with a female or receptacle connector by inserting the plug connector into the receptacle connector.

In many instances, it is desirable to provide for "keying" of the mateable connectors in such electrical connector assemblies so that the connectors can be mateable in only one given orientation. It also may be desirable to "polarize" a connector assembly so that only one given male or plug connector, for instance, can be mateable with a given female or receptacle connector. In some instances, the keying means of the connectors performs the dual function of also polarizing the connectors of the assembly.

Heretofore, keying and/or polarizing means or systems have caused molding problems with the connector housings. In addition, keying and/or polarizing means often project outwardly of a given connector profile. If restrictions are placed on the profile or size of a particular connector, such as restricting the size of a connector for insertion through a small opening in a panel or backplane, the keying and/or polarizing means may interfere with other necessary components of the connector if not projecting outwardly of the connector profile.

The structural integrity of the connector in combination with the keying is also important. Structural integrity is provided by the support walls joining the silos. The existence of support walls extending from the body portion to the distal ends of the silos also presented a problem for designing a simple keying arrangement.

The present invention is directed to solving these problems by providing a simple keying and/or polarizing system which is easy to mold and which is disposed entirely within an intended or given profile or periphery of a particular connector assembly.

SUMMARY OF THE INVENTION

An object, therefore, of the invention is to provide a new and improved keying system for an electrical connector assembly.

In the exemplary embodiments of the invention, a male connector has a body portion, a mating end formed by a plurality of terminal-receiving silos extending from the body portion, and a plurality of support walls integrally joining each silo with at least two other silos. The support walls extend substantially from the body portion to distal ends of the silos. The support walls and silos define a pattern of interior keying channels. At least one of the keying channels is substantially closed on the sides thereof.

A female connector of the connector assembly has a mating end formed by a receptacle for receiving the mating end of the male connector. A plurality of terminals include contact portions extending into the receptacle for insertion into the silos into engagement with the terminals of the male connector when the connectors are mated. A plurality of locating walls are formed within the receptacle between the contact portions of the terminals to define a pattern of keying members for insertion into the keying channels of the male connector to thereby polarize the connectors.

According to one aspect of the invention, the silos of the male connector are orthogonal in cross-section defined by straight side walls. The support walls are straight extensions of some of the side walls of some of the silos.

According to another aspect of the invention, the locating walls within the receptacle of the female connector are of substantially consistent thickness. This facilitates molding the walls integrally with the female connector.

In one embodiment of the invention, the female connector includes a plurality of the receptacles for respectively receiving a plurality of the male connectors. The pattern of keying members within each receptacle is different from the pattern of keying members of any other receptacle. The pattern of keying channels of each male connector matches the pattern of keying members of only one of the receptacles.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
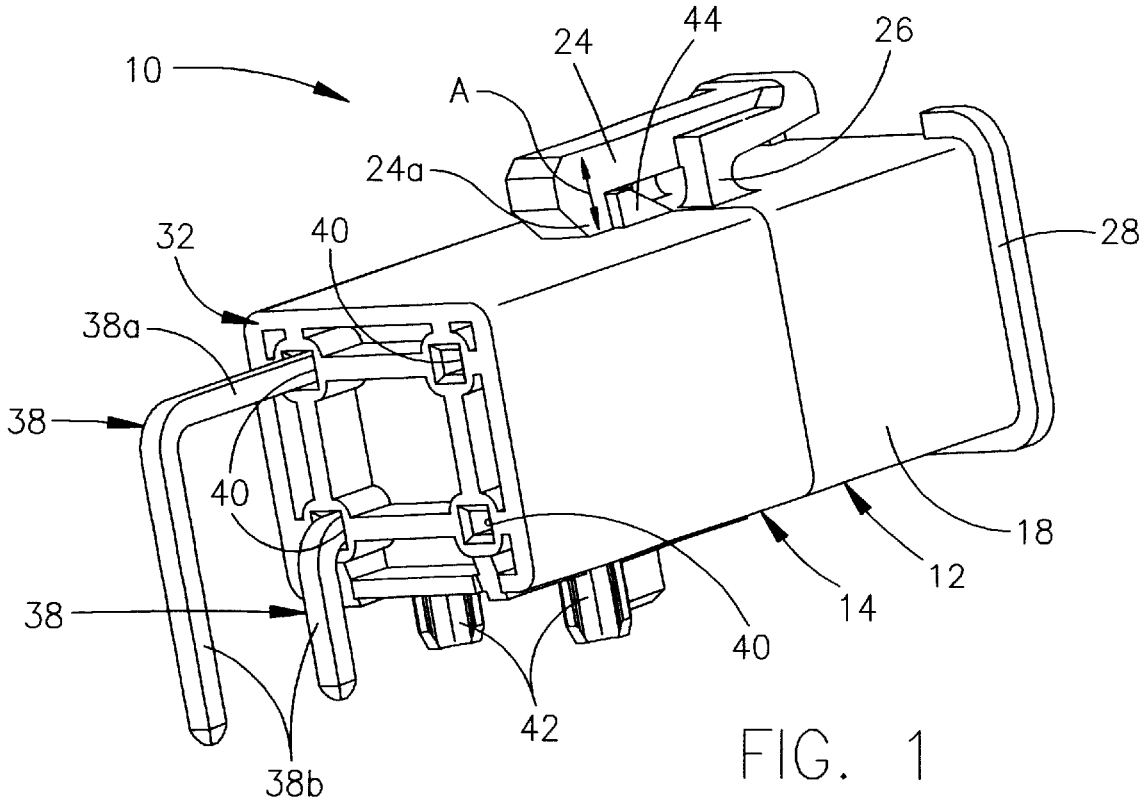
FIG. 1 is a perspective view of one embodiment of an electrical connector assembly incorporating the concepts of the invention.
Figure 2:
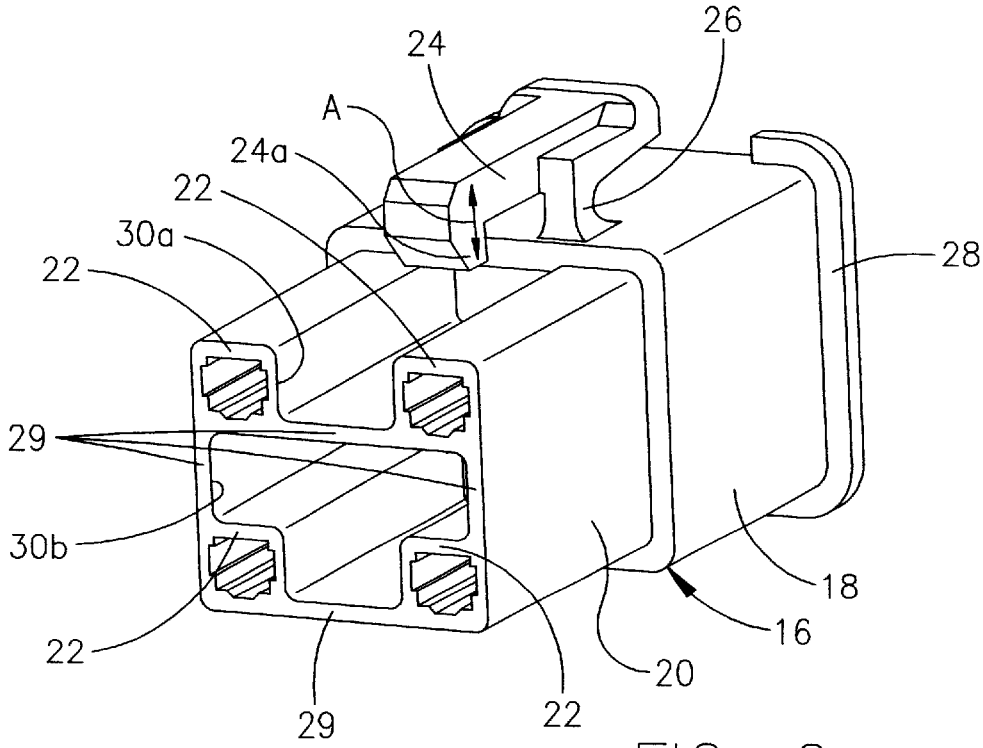
FIG. 2 is a perspective view looking at the mating end of the male connector of the assembly of FIG. 1.
Figure 3:
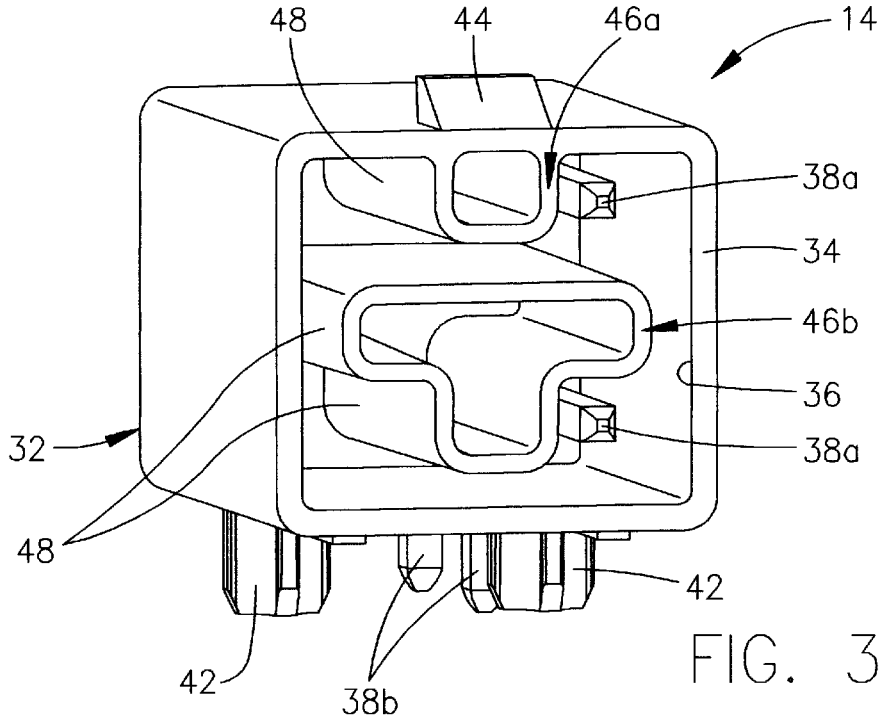
FIG. 3 is a perspective view looking at the mating end of the female connector of the assembly of FIG. 1.
Figure 4:
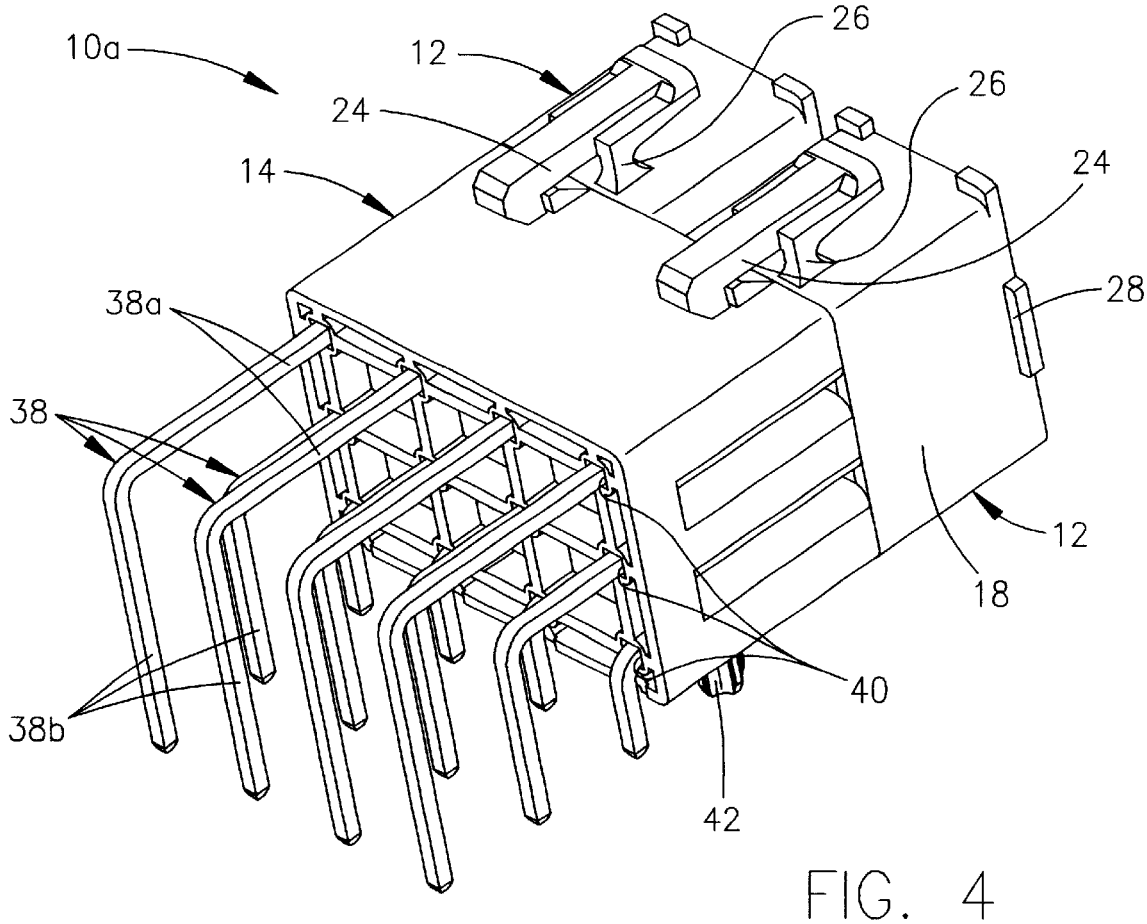
FIG. 4 is a perspective view of a second embodiment of an electrical connector assembly incorporating the concepts of the invention.
Figure 5:
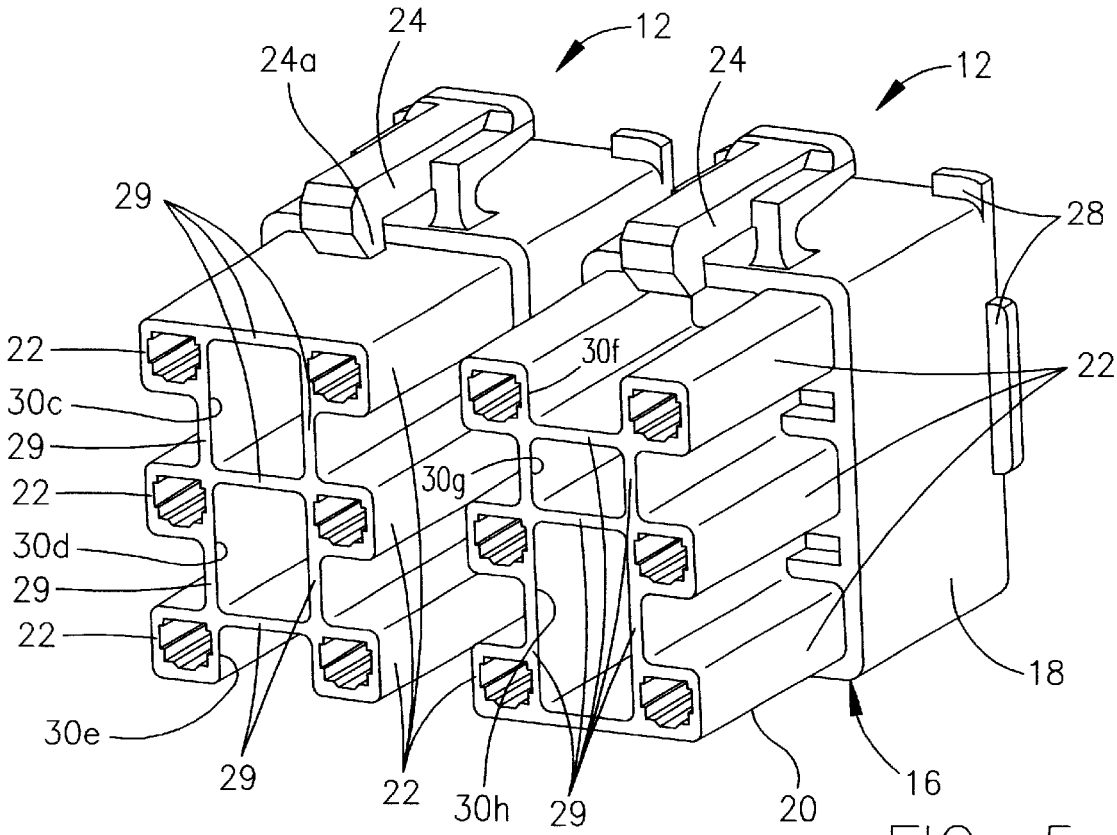
FIG. 5 is a perspective view looking at the mating end of a pair of male connectors in the assembly of FIG. 4.
Figure 6:
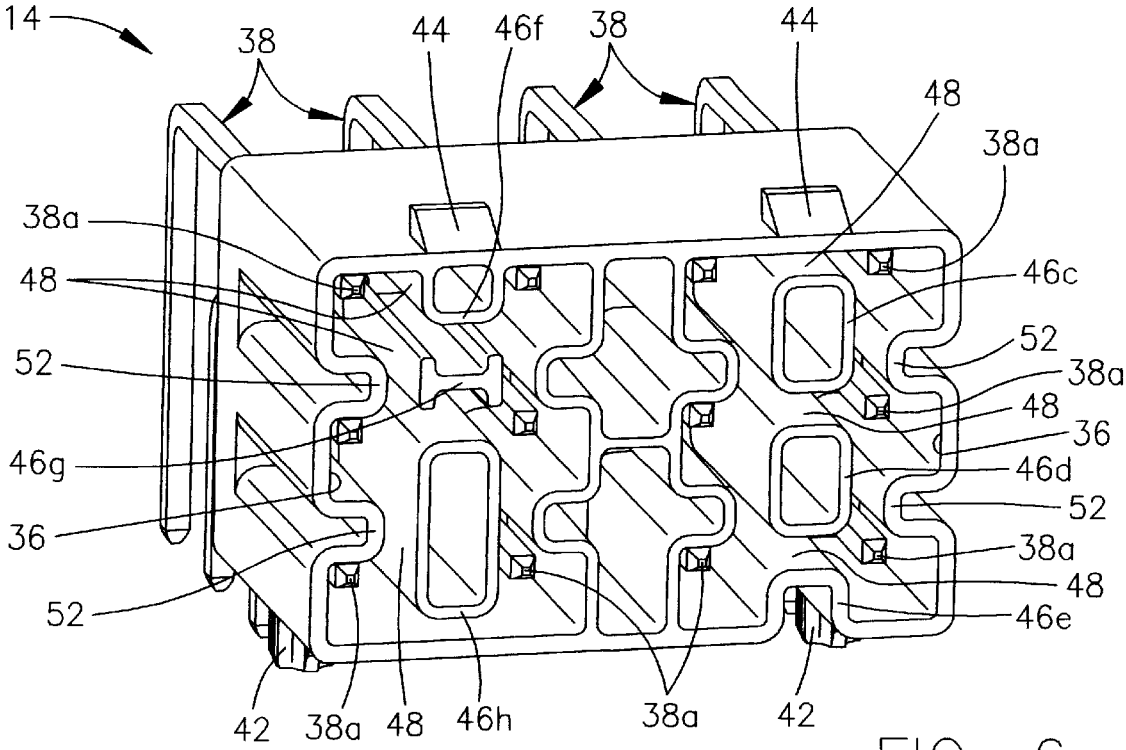
FIG. 6 is a perspective view looking at the mating end of the single female connector of the assembly of FIG. 4.

Referring to the drawings in greater detail, FIGS. 1–3 show a first embodiment of an electrical connector assembly, generally designated 10, incorporating the keying system of the invention. FIGS. 4–6 show a second embodiment of an electrical connector assembly, generally designated 10A, incorporating the keying system of the invention. Like reference numerals may be applied in all of the drawings to designate like components which are common to all of the embodiments. In addition, the term "keying" is used herein in its broadest context, i.e. to include "polarizing" of a plurality of connectors, all within the context of those terms described in the "Background", above.

With those understandings, electrical connector assembly 10 in FIGS. 1–3 includes a male or plug connector, generally designated 12 (FIG. 2), which is mateable with or inserted into a female connector, generally designated 14 (FIG. 3), as seen by the mated depiction of the connectors in FIG. 1.

Referring to FIG. 2 in conjunction with FIG. 1, male connector 12 includes a one-piece housing, generally designated 16, which includes a body portion 18 and a mating end 20 formed by a plurality of terminal-receiving silos 22 extending from the body portion. The entire one-piece housing may be unitarily molded of dielectric material such as plastic or the like. A flexible latch arm 24 is pivotally connected to the housing intermediate the ends of the latch arm by a fulcrum 26 which is molded integrally with the housing. The latch arm has an inwardly directed latch hook 24*a* at the distal end thereof. Therefore, the latch hook can move with the latch arm about fulcrum 26 in the direction of double-headed arrow "A". Body portion 18 may be insertable through an opening in a panel or backplane, with an outwardly projecting flange 28 being provided for to hold the overmolded housing. A plurality of terminals (not shown) are mounted in housing 16 of male connector 12. As is known in the art, the terminals have contact portions extending into silos 22.

As best seen in FIG. 2, the keying system of the invention is provided by a plurality of support walls 29 molded integrally with and joining selected ones of silos 22. The support walls extend substantially from body portion 18 to the distal ends of the silos. The support walls and the silos combine to define a pattern of interior keying channels, such as keying channels 30*a* and 30*b*. It can be seen in FIG. 2 that keying channel 30*a* is located between the upper two silos 22 and is generally rectangular in configuration. Keying channel 30*b* is much larger and is generally T-shaped, with the leg of the T-shaped channel extending between the bottom pair of silos 22.

Referring to FIG. 3 in conjunction with FIG. 1, female connector 14 also includes a one-piece molded housing, generally designated 32, having a mating end 34 formed by a receptacle 36 which receives mating end 20 of male connector 12. A plurality of terminals, generally designated 38 (FIG. 1), are mounted on the female housing and include contact portions or pins 38*a* extending into receptacle 36. Although only two terminals 38 are shown in the drawings, the housing mounts four terminals and their respective contact pins 38*a* extend through four terminal-receiving passages 40 (FIG. 1) in the rear of housing 32. The terminals are L-shaped and include tail portions 38*b* for insertion into holes in an appropriate printed circuit board and for connection to circuit traces on the board and/or in the holes. A pair of mounting posts 42 are molded integrally with housing 32 for insertion into appropriate mounting holes in the printed circuit board. An integral, chamfered latch boss 44 projects upwardly from housing 32 for latching engagement with latch hook 24*a* of latch arm 24 of male connector 12 when the connectors are mated as seen in FIG. 1.

As best in FIG. 3, the keying system of the invention contemplates a pattern of keying members, generally designated 46*a* and 46*b*, which are formed by a plurality of locating walls 48 entirely within receptacle 36 between contact pins 38*a*. Preferably, locating walls 48 are of substantially consistent thicknesses to facilitate easy molding of the overall connector housing. In comparing the mating end of female connector 32 in FIG. 3 with the mating end of male connector 12 in FIG. 2, it can be seen that keying member 46*a* (FIG. 3) is generally rectangular for insertion into keying channel 30*a* of male connector 12. Keying member 46*b* (FIG. 3) is generally T-shaped to match the configuration of keying channel 30*b* (FIG. 2) of the male connector. Therefore, when the connectors are mated as shown in FIG. 1, keying members 46*a* and 46*b* are easily insertable into keying channels 30*a* and 30*b*, respectively. However, if the connectors are inverted or otherwise oriented to misalign keying members 46*a* and 46*b* with keying channels 30*a* and 30*b*, the connector cannot be mated. In addition, no other, differently keyed or polarized connector can be mated in the assembly of FIG. 1.

The second embodiment of electrical connector assembly 10A shown in FIGS. 4–6 employs the same general type of keying system as described above in relation to the first embodiment of connector assembly 10 in FIGS. 1–3. Therefore, as stated above, like reference numerals are applied in FIGS. 4–6 corresponding to like components described above in relation to FIGS. 1–3, and certain descriptions will not be repeated in order to avoid unduly lengthening the description. The principal difference in the second embodiment of connector assembly 10A in FIGS. 4–6 is that female connector 14 (FIGS. 4 and 6) includes a pair of receptacles 36 for receiving a pair of male connectors 12 (FIG. 5).

Comparing the two male connectors 12 in the second embodiment of FIG. 5 with the single male connector 12 in the first embodiment of FIG. 2, it can be seen that silos 22 again are joined by a plurality of internal support walls 29. In both embodiments, not only do walls 29 support silos 22 but the support walls combine with the silos to define the internal keying channels of the male connectors. For instance, the silos and support walls in the left-hand male connector 12 shown in FIG. 5 form two upper keying channels 30*c* and 30*d* which are closed and of generally equal size, along with an open bottom keying channel 30*e*. The support walls and silos of the right-hand male connector 12 in FIG. 5 combine to define an open top keying channel 30*f*, a smaller closed keying channel 30*g* and a larger closed keying channel 30*h*. It is readily apparent that the pattern of keying channels in male connector 12 of the first embodiment shown in FIG. 2, as well as both male connectors 12 of the second embodiment shown in FIG. 5, all have different patterns of keying channels 30*a*–30*h*.

FIG. 6 shows that each of the two receptacles 36 of single female connector 14 of the second embodiment includes a different pattern of keying members complementary to the different patterns of keying channels of the male connectors 12 of FIG. 5. Specifically, looking at the right-hand receptacle 36 in FIG. 6, a plurality of locating walls 48 define a pair of keying members 46*d* and a third keying member 46*e* which correspond in size and shape with keying channels 30*c*, 30*d* and 30*e* of the left-hand male connector 12 shown in FIG. 5. Similarly, locating walls 48 within the left-hand receptacle 36 define keying members 46*f*, 46*g* and 46*h* which are complementary in shape with keying channel 30*f*, 30*g* and 30*h*, respectively, of the right-hand male connector 12 shown in FIG. 5. Therefore, the left-hand male connector 12 in FIG. 5 can only be inserted into the right-hand receptacle 36 of female connector 14 in FIG. 6. Similarly, the right-hand male connector 12 in FIG. 5 can only be inserted into the left-hand receptacle 36 of female connector 14 in FIG. 6.

Finally, female connector 14 of the second embodiment in FIG. 6 includes a plurality of side indentations 52 which project inwardly between contact pins 38*a*. These indentations ride between silos 22 on the outsides of male connectors 12 of FIG. 5.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A keying system for an electrical connector assembly, comprising:

a male connector having a body portion, a mating end formed by a plurality of terminal-receiving silos extending from the body portion, and a plurality of support walls integrally joining each silo with at least two other silos, the support walls extending from the body portion to distal ends of the silos, the support walls and silos defining a pattern of interior keying channels with at least one of the keying channels being closed on the sides thereof, said support walls and said silos further defining a continues outer perimeter;

a female connector having a mating end formed by a receptacle for receiving the mating end of the male connector, a plurality of terminals including contact portions extending into the receptacle for insertion into the silos into engagement with the terminals of the male connector when the connectors are mated, and a plurality of locating walls within the receptacle between the contact portions of the terminals defining a pattern of keying members for insertion into the keying channels of the male connector wherein said receptacle and said locating walls defining a perimeter of the female connector, wherein said outer perimeter insertable within said perimeter of said female connector, wherein portions of the locating walls partly conforming to said silos on the male connector, to thereby polarize the connectors; and the support walls and the silos of the male connector and the locating walls of the receptacle of the female connector having a substantially consistent wall thickness.

2. The keying system of claim 1 wherein said silos of the male connector are orthogonal in cross-section defined by straight side walls, and said support walls are straight extensions of some of the side walls of some of the silos.

3. The keying system of claim 1 wherein said female connector includes a plurality of said receptacles for respectively receiving a plurality of said male connectors, the pattern of keying members within each receptacle being different from the pattern of keying members of any other receptacle, and the pattern of keying channels of each male connector matching the pattern of keying members of only one of the receptacles.

4. The keying system of claim 1 wherein at least one of said keying members comprises a silo structure.

* * * * *